US006711368B2

(12) United States Patent
Ogasawara

(10) Patent No.: US 6,711,368 B2
(45) Date of Patent: Mar. 23, 2004

(54) IMAGE FORMING APPARATUS DESIGNED TO PREVENT CURLING OF A CLEANING BLADE

(75) Inventor: Masato Ogasawara, Tokyo (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/012,358

(22) Filed: Dec. 12, 2001

(65) Prior Publication Data

US 2003/0108360 A1 Jun. 12, 2003

(51) Int. Cl.[7] ..... G03G 15/00
(52) U.S. Cl. ..... 399/159; 399/343
(58) Field of Search ..... 399/71, 159, 160–165, 399/302, 308, 363, 366, 347, 350, 273, 283; 430/56, 59, 66, 67; 15/236.01

(56) References Cited

U.S. PATENT DOCUMENTS 5,389,478 A * 2/1995 Yoshida et al. ..... 430/59
5,715,510 A * 2/1998 Kusaba et al. ..... 399/308
5,995,785 A * 11/1999 Kato et al. ..... 399/350 X
6,014,530 A * 1/2000 Tsunemi ..... 399/350 X
6,044,245 A * 3/2000 Kabashima et al. ..... 399/350
6,063,532 A * 5/2000 Miyake ..... 399/159 X
6,253,044 B1 * 6/2001 Shoji et al. ..... 399/347 X
6,453,137 B2 * 9/2002 Iinuma ..... 399/159

FOREIGN PATENT DOCUMENTS

JP 3-1979 1/1991
JP 3-197952 8/1991
JP 7-319539 12/1995

* cited by examiner

*Primary Examiner*—Hoan Tran
(74) *Attorney, Agent, or Firm*—Foley & Lardner

(57) ABSTRACT

An image forming apparatus is provided which is capable of preventing a cleaning blade from being curled up or turned over as the operating time of the image forming apparatus elapses, or due to the shape of an image forming pattern. In the image forming apparatus, an image is formed by using a photoreceptor having a photosensitive layer formed on an outer surface thereof, and a residual toner on the surface of the photoreceptor is scraped off by a cleaning blade which is made into abutment with the photoreceptor. In this case, processing for continuously reducing a friction against the photoreceptor with which the cleaning blade abuts is carried out on the photoreceptor in the outside of an image forming area in a central portion of the photoreceptor on which the image is formed. Such processing is to form a plurality of parallel ring-shaped grooves on the outer surface of a photoreceptor original pipe, which is a base material for the photoreceptor, outside the image forming area, and depths Rz of the grooves are set to be 1.7 $\mu$m–2.5 $\mu$m.

14 Claims, 6 Drawing Sheets

IMAGE FORMING APPARATUS DESIGNED TO PREVENT CURLING OF A CLEANING BLADE

BACKGROUND OF THE INVENTION

1. Field of the Invention

The present invention relates to an image forming apparatus such as a copying machine, etc., and more specifically, to an image forming apparatus with a blade-shaped abutment member which includes an image carrying member having a photosensitive layer and a photosensitive layer carrying member carrying thereon the photosensitive layer, and in which a latent image is formed on the image carrying member in an image forming area thereof in accordance with image information and developed to provide a toner image, which is then transferred to a transfer material, whereupon the residual toner attached to the image carrying member is removed by the abutment member.

2. Description of the Related Art

FIG. 10 is a cross sectional view illustrating the relation between a cylindrical (drum-shaped) photoreceptor (cylindrical photoreceptor) and a cleaning part for removing the toner, which is not transferred but remains on the photoreceptor, from the photoreceptor, in an image forming apparatus such as a copying machine, etc., applying electrophotography. There are two types of cleaning parts, one using a cleaning blade and the other using a roller in the form a fur brush. Practically, the main stream of the cleaning parts is a technique of using a cleaning blade 81 as shown in FIG. 10 because it is at low costs, easy to design, excellent in the scraping function, and so on. A photoreceptor 70 in FIG. 10 is used for repeatedly performing the processes of charging, image exposure, development, transfer, cleaning, etc., while being rotated in a direction of an arrow RR. Among these processes, a cleaning part 80 is used for removing the toner remaining on the photoreceptor 70 after the transfer process, and plays an important role of forming a clear copy image.

In the example as described above, the cleaning part 80 uses a plate-like cleaning blade 81 for removing toner. In this case, the cleaning blade 81 is mounted in such a manner that one 81*a* of opposite edges 81*a*, 81*b* of one side of the cleaning blade 81 is in abutment with a surface of the photoreceptor 70. Thus, in the cross sectional view of FIG. 10, the cleaning blade 81 is mounted in such a manner that an angle $\phi$, which is formed between the cleaning blade 81 and the tangent line of the photoreceptor 70 at a location at which the cleaning blade 81 abuts against the photoreceptor 70, become an acute angle. This angle $\phi$ is set such that the toner, which remains on the photoreceptor 70 without being transferred, can be efficiently scraped off and dropped into a collection part 82 in opposition to the rotation of the photoreceptor 70 in the direction of the arrow RR.

The cleaning part of the above-mentioned known image forming apparatus has an excellent cleaning characteristic through the use of the cleaning blade, but is apt to produce a large friction between the cleaning blade and the photoreceptor. As a result, there would arise a problem that those portions of the cleaning blade 81 in the vicinity of edges 81*a*, 81*b* thereof which are in abutment with the photoreceptor 70 are easily inverted or turned over (hereinafter also referred to as curling) due to the large friction, as shown in FIG. 11. Referring to FIG. 11, the portions of the cleaning blade 81 in the vicinity of the edges 81*a*, 81*b* thereof are turned over or curled up, so the edge 81*b*, instead of the edge 81*a* which has abutted against the photoreceptor 70 before occurrence of the turned-over or curling state, comes to be pressed against the surface of the photoreceptor 70, from which it will be understood that it is difficult to scrape off the toner remaining on the photoreceptor therefrom.

As a proposal for solving the problem of the known image forming apparatus as described above, there are inventions disclosed in Japanese Patent Application Laid-Open No. Hei 3-1979 and Japanese Patent Application Laid-Open No. Hei 7-319359 for instance. In the invention disclosed in Japanese Patent Application Laid-Open No. Hei 3-1979, the photoreceptor is prevented from being curled up by applying a lubricant such as an organic solvent dispersing liquid of lubricating minute powder such as Kynar, etc., to the surface of the photoreceptor at the initial stage of using the image forming apparatus. The lubricant is gradually removed from the photoreceptor as the operating time elapses, and does not serve for a lubricating function, but it is intended for toner to succeed the role of the lubricant in place thereof, thereby preventing curling of the photoreceptor.

In the above case, however, there is another problem in that if the lubricant, which is attached to the photoreceptor by application of the organic solvent dispersing liquid, is prevented from being detached from the photoreceptor so as to sustain the intended effect of the lubricant, an adverse influence resulting therefrom would appear to an image to be formed, giving rise to an image defect. Additionally, in this case, the photoreceptor includes an image forming area in which an image is formed according to image information. and a developing area which is wider than the image forming area and in which development is carried out by toner, and hence the toner used for development is supplied to the cleaning blade in a portion of the cleaning blade corresponding to the developing area, so that there would be little fear that a large friction might be generated between the cleaning blade and the photoreceptor. However, toner is not sufficiently supplied to the portions of the cleaning blade corresponding to those portions of the photoreceptor which lie outside the developing area thereof, thus causing a further problem that a large friction is created between the cleaning blade and the photoreceptor, from where the edges of the cleaning blade come to be easily turned over.

In the invention disclosed in Japanese Patent Application Laid-Open No. Hei 7-319359, there is proposed a technology of preventing the problem encountered with the above-mentioned invention, i.e., the turning over or curling in the portions of the cleaning blade, which lie outside the width of the developing area of the photoreceptor. In this proposal, development holding members are arranged at opposite ends of the cleaning blade, and intended to serve the purpose that the toner lying outside the width of developing area on a transfer belt is wiped off so as to adjust the toner to a suitable amount when the amount of toner is excessive, and the toner wiped off is made to attach to the transfer belt when the amount of toner lying outside the width of the developing area is too small, thereby making it possible to supply the toner to the entire surface of the cleaning blade. However, there arises a further problem that if non-image patterns continue at the opposite ends of the width of each image in the formation of images on the photoreceptor, toner would not be accumulated on the development holding members, thus resulting in a situation that there easily takes place curling of the cleaning blade.

SUMMARY OF THE INVENTION

The present invention is intended to solve the problems as referred to above, and has for its object to provide an image forming apparatus which is capable of preventing a cleaning blade from being curled up or turned over with the passage of an operation time thereof or due to the shapes of patterns forming images even when a cleaning blade, which is low in cost, easy to design and excellent in a toner scraping function, is used as a cleaning device.

In order to solve the above-mentioned problems, the present invention resides in an image forming apparatus which includes: an image carrying member (photoreceptor) having a photosensitive layer and a photosensitive layer carrying member (original pipe) carrying the photosensitive layer; a latent image forming device for forming a latent image on the image carrying member in accordance with image information; a developing device for forming a toner image on the latent image; a transfer device for transferring the toner image to a transfer material; and a cleaning device for removing a residual toner attached to the image carrying member by means of a blade-shaped abutment member (cleaning blade); and which is characterized in that a surface roughness of the photosensitive layer carrying member is greater outside the latent image forming area on the image carrying member than in the latent image forming area.

Moreover, the image forming apparatus according to the present invention is characterized in that concavities and convexities are provided on the photosensitive layer carrying member in a direction parallel to a direction in which the image carrying member rotates.

In addition, the image forming apparatus according to the present invention is characterized in that a surface roughness Rz outside the latent image forming area is 1.7–4.0 $\mu$m.

Further, the image forming apparatus according to the present invention is characterized in that a range in which the surface roughness of the photosensitive layer carrying member is made greater is outside the latent image forming area and outside a location lying inside the developing area.

Furthermore, the image forming apparatus according to the present invention is characterized in that a range in which the surface roughness of the photosensitive layer carrying member is made greater is outside the developing area and outside a location lying inside the abutment member.

Still further, the image forming apparatus according to the present invention is characterized in that the image carrying member is cylindrical.

Besides, the image forming apparatus according to the present invention is characterized in that the image carrying member is of a belt-shaped configuration.

Moreover, the present invention resides in an image forming apparatus which includes: an image carrying member (photoreceptor) having a photosensitive layer and a photosensitive layer carrying member (original pipe) carrying the photosensitive layer; a latent image forming device for forming a latent image on the image carrying member in accordance with image information; a developing device for forming a toner image on the latent image; a transfer device for transferring the toner image to a transfer material; and a cleaning device for removing a residual toner attached to the image carrying member by means of a blade-shaped abutment member (cleaning blade); and which is characterized in that a lubricant having a friction against said abutment member smaller than that of the photosensitive layer is applied to the photosensitive layer carrying member outside the latent image forming area on the image carrying member.

In addition, the image forming apparatus according to the present invention is characterized in that a range in which the lubricant is applied is outside the latent image forming area and outside a location lying inside the developing area for forming the toner image, Further, the image forming apparatus according to the present invention is characterized in that a range in which the lubricant is applied is outside the developing area and outside a location lying inside the abutment member.

Furthermore, the present invention resides in an image forming apparatus which includes: an image carrying member (photoreceptor) having a photosensitive layer and a photosensitive layer carrying member (original pipe) carrying the photosensitive layer; a latent image forming device for forming a latent image on the image carrying member in accordance with image information; a developing device for forming a toner image on the latent image; a transfer device for transferring the toner image to a transfer material; and a cleaning device for removing a residual toner attached to the image carrying member by means of a blade-shaped abutment member (cleaning blade); and which is characterized in that outside the latent image forming area on the image carrying member, the photosensitive layer is removed from the photosensitive layer carrying member, and a friction against the abutment member is smaller in the photosensitive layer carrying member than in the photosensitive layer.

Still further, the image forming apparatus according to the present invention is characterized in that a surface of the photosensitive layer carrying member is formed of an electroconductive fluorocarbon resin.

Besides, the image forming apparatus according to the present invention is characterized in that a range in which the photosensitive layer is removed is outside the latent image forming area and outside a location lying inside the developing area.

Moreover, the image forming apparatus according to the present invention is characterized in that a range in which the photosensitive layer is removed is outside the developing area and outside a location lying inside the abutment member.

In addition, the present invention resides in an image forming apparatus which includes; an image carrying member (photoreceptor) having a photosensitive layer and a photosensitive layer carrying member (original pipe) carrying the photosensitive layer; a latent image forming device for forming a latent image on the image carrying member in accordance with image information; a developing device for forming a toner image on the latent image; an intermediate transfer device for transferring the toner image so as to temporarily carry it thereon; a transfer device for transferring the toner image on the intermediate transfer device to a transfer material; and an intermediate transfer cleaning device for removing a residual toner attached to the intermediate transfer device by means of a blade-shaped intermediate transfer abutment member (cleaning blade); and which is characterized in that a friction against the intermediate transfer abutment member is smaller in portions of the intermediate transfer device outside the latent image forming area than in a portion of the intermediate transfer device in the latent image forming area.

Further, the image forming apparatus according to the present invention is characterized in that a lubricant is applied to the portions of the intermediate transfer device outside the latent image forming area.

Furthermore, the present invention resides in an image forming apparatus which includes: an image carrying member (photoreceptor) having a photosensitive layer and a belt-shaped photosensitive layer carrying member carrying the photosensitive layer; a plurality of image carrying member tensioning shafts among which the image carrying member is arranged under tension; a latent image forming device for forming a latent image on the image carrying member in accordance with image information; a developing device for forming a toner image on the latent image; a transfer device for transferring the toner image to a transfer material; and a cleaning device for removing a residual toner attached to the image carrying member by means of a blade-shaped abutment member (cleaning blade); and which is characterized in that the abutment member is greater in width than the image carrying member, and is arranged in a position to clamp the image carrying member together with one of the image carrying member tensioning shafts; and a friction against the abutment member is smaller at least in a portion of the image carrying member tensioning shaft with which the abutment member is in direct contact than in the image carrying member.

Still further, the image forming apparatus according to the present invention is characterized in that a lubricant is applied to at least the portion of the image carrying member tensioning shaft with which the abutment member is in direct contact.

Moreover, the present invention resides in an image forming apparatus which includes: an image carrying member (photoreceptor) having a photosensitive layer and a photosensitive layer carrying member (original pipe) carrying the photosensitive layer; a latent image forming device for forming a latent image on the image carrying member in accordance with image information; a developing device for forming a toner image on the latent image; a transfer device for transferring the toner image to a transfer material; a transfer material conveying device (transfer belt) for conveying the transfer material to the transfer device while carrying the transfer material thereon; a plurality of transfer material conveying tensioning shafts among which the transfer material conveying device is arranged under tension; and a transfer material conveying cleaning device for removing a residual toner attached to the transfer material conveying device by means of a blade-shaped transfer material conveying abutment member (cleaning blade); and which is characterized in that the transfer material conveying abutment member is larger in width than the transfer material conveying device, and arranged in a position to clamp the image carrying member together with one of the transfer material conveying tensioning shafts; and a friction against the transfer material conveying abutment member is smaller at least in a portion of the transfer material conveying tensioning shaft with which the transfer material conveying abutment member is in direct contact than in the transfer material conveying device.

Additionally, the image forming apparatus according to the present invention is characterized in that a lubricant is applied to at least the portion of the transfer material conveying tensioning shaft with which the transfer material conveying abutment member is in direct contact.

According to the arrangements as described above, such processing as adversely affecting the formation of an image is not performed in the image forming area, so it is possible to form an excellent image. Outside the image forming area, however, processing for reducing a friction against a contacting cleaning blade is carried out, thus avoiding curling or turning over of portions of the cleaning blade near its ends, which would otherwise be liable to be caused. In addition, with such a construction, friction can be continuously reduced, thus making it possible to scrape off a residual toner on a photoreceptor in a stable manner for a long period of time.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
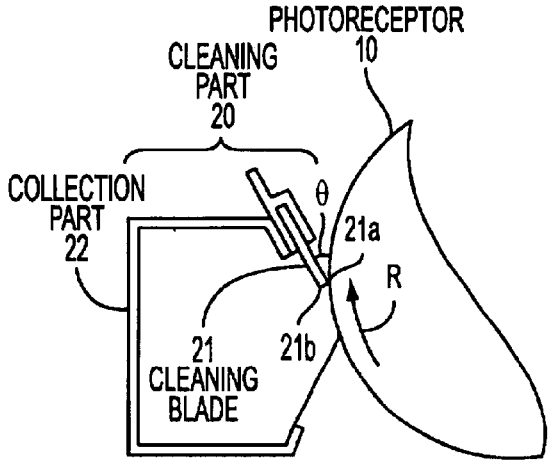
FIG. 1 is a cross sectional view showing an image forming apparatus according to a first embodiment of the present invention, in particular illustrating the relation between a cylindrical photoreceptor used in the image forming apparatus and a cleaning part for removing from the photoreceptor the toner which is not transferred but remaining on the photoreceptor.
Figure 2:
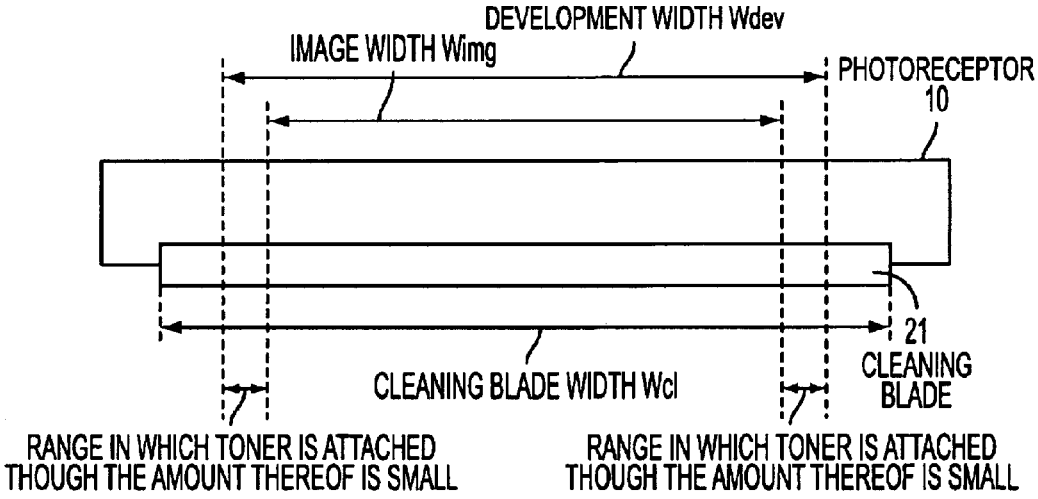
FIG. 2 is a view explaining the relation between respective functional areas of the photoreceptor of FIG. 1 and a cleaning blade of the cleaning part.
Figure 3:
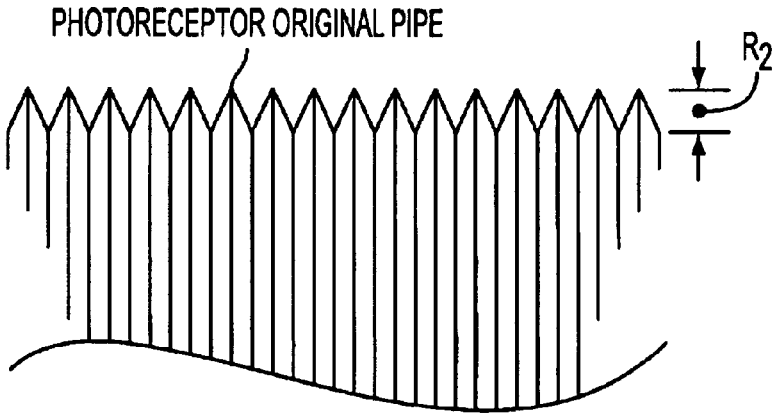
FIG. 3 is a partially enlarged view explaining the content of processing performed on a photoreceptor original pipe which is a base material for the photoreceptor of FIG. 1.
Figure 4:
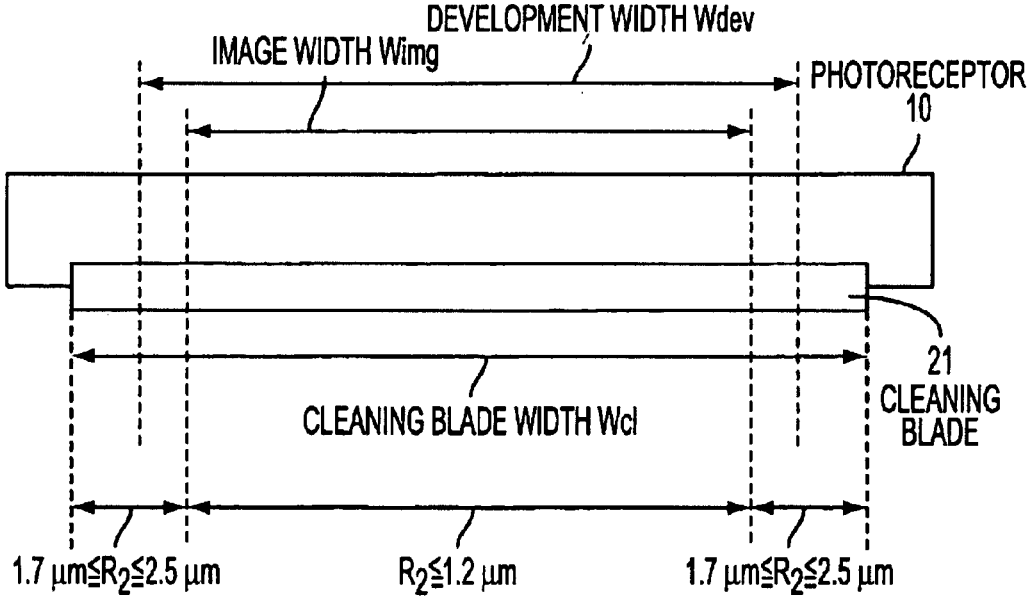
FIG. 4 is a view explaining the content of processing performed on the respective functional areas of the photoreceptor.
Figure 5:
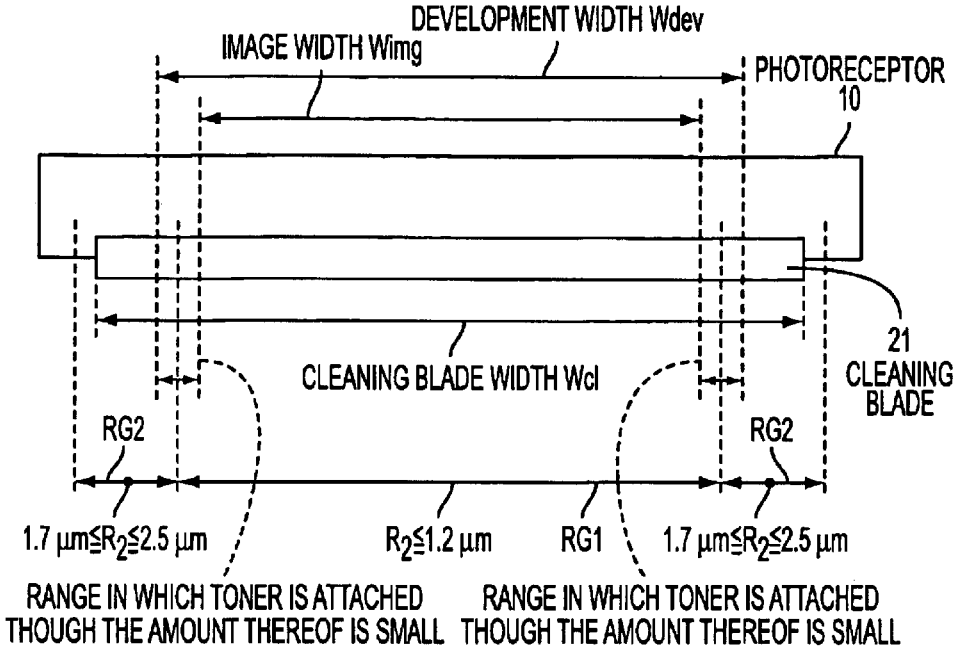
FIG. 5 is a view explaining the processing of FIG. 4 slightly modified.

Hereinafter, preferred embodiments of the present invention will be described in detail while referring to the accompanying drawings. FIG. 1 is a cross sectional view which shows an image forming apparatus according to a first embodiment of the present invention, particularly illustrating the relation between a cylindrical (drum-shaped) photoreceptor (cylindrical photoreceptor) used in the image forming apparatus and a cleaning part for removing from the photoreceptor the toner which is not transferred but remains on the photoreceptor. FIG. 2 is a view explaining the relation between respective functional areas of the photoreceptor of FIG. 1 and a cleaning blade of the cleaning part. FIG. 3 is a partially enlarged view explaining the content of processing performed on a photoreceptor original pipe which is a base material for the photoreceptor of FIG. 1. FIG. 4 is a view explaining the content of processing performed on the respective functional areas of the photoreceptor in the first embodiment of the present invention. FIG. 5 is a view explaining the content of processing of FIG. 4 slightly modified.

Embodiment 1

A photoreceptor 10 of the image forming apparatus illustrated in FIG. 1 is used for repeatedly performing the processes of charging, image exposure, development, transfer, cleaning and so on, while being rotated in a direction of an arrow R. Among these processes, a cleaning part (cleaning device) 20 is used for removing the toner remaining on the photoreceptor 10 after the transfer process, and plays an important role for the purpose of forming a clear copy image. The photoreceptor 10, which is an image carrying member in this example, is comprised of a photoreceptor original pipe and an organic photosensitive layer formed thereon. The organic photosensitive layer includes a charge generation layer made of phthalocyanine type pigments formed on the photoreceptor original pipe, and a charge transporting layer made of polycarbonate having hydrazone type pigments dispersed on the charge generation layer. Moreover, the photoreceptor original pipe is made of a cylindrical base material in the form of aluminum, with the surface thereof being subjected to special processing by a cutting tool according to the present invention, as will be described later.

When the total length of the photoreceptor 10 in FIG. 1 is divided into respective functional areas, these areas include an image forming area (latent image forming area) in the central part where a latent image forming device of the image forming apparatus forms an image with a laser beam, etc., based on image information, a developing area covering the image forming area and extending therefrom to the outside thereof, where development is carried out by means of a developing device such as a developing roller, etc., and a cleaning area where the cleaning blade, which is an abutment member of the cleaning device, is adapted to abut against the photoreceptor. The widths of these areas are represented by an image width Wimg, a development width Wdev, and a cleaning blade width Wcl, respectively, as shown in FIG. 2. It is necessary to develop an image formed in the image forming area of the image width Wimg, so the development width Wdev is set equal to or greater than the image width Wimg. Also, it is necessary to set the cleaning blade width Wcl such that the cleaning blade can remove the toner remaining on the photoreceptor 10 after a transfer process for transferring an unillustrated toner image onto a transfer material has been carried out by a transfer device. If, otherwise, the cleaning blade width Wcl is set, unlike this, such that the cleaning blade width Wcl is less than the development width Wdev, the toner attached to the portions of the photoreceptor lying outside the cleaning blade might be scattered into the apparatus to contaminate the surroundings. Thus, the relation between these three widths shown in FIG. 2 is represented by the following expression (1); that is, $$Wcl > Wdev \geqq Wimg \quad (1)$$

In addition, the cleaning part 20 shown in FIG. 1 is provided with a plate-like cleaning blade 21 made of a rubber material for instance, in order to remove toner. The cleaning blade 21 is arranged in such a manner that one 21*a* of edges 21*a*, 21*b* of one side of the cleaning blade 21 is in abutment with the surface of the photoreceptor 10, that is, an angle θ formed between the cleaning blade and a tangent line of the photoreceptor 10 at a point at which the photoreceptor 10 contacts the edge 21*a* becomes an acute angle in the cross sectional view of FIG. 1. This angle θ is set such that the toner remaining on the photoreceptor 10 without being transferred to paper is scraped off efficiently to be dropped into a collection part 22 in opposition to the rotation of the photoreceptor 10 in the direction of the arrow R.

The following experiments were conducted with respect to the photoreceptor original pipe of the photoreceptor 10 of the image forming apparatus of FIG. 1. In this case, the photoreceptor original pipe, which is the base material for the photoreceptor 10, is made of aluminum, with the entire surface thereof being subjected to the special processing by means of the cutting tool, as already described. The special processing is carried out in such a manner that there are formed iterative ring-shaped concavities and convexities (for instance, cross sectional shapes such as isosceles triangles, sawtooth waves, etc.), as shown in FIG. 3. In the experiments, photoreceptor original pipes having surface roughnesses Rz (heights or depths of the concavities and convexities) set from 0.5 μm to 4.2 μm were prepared, as shown in Table 1 below. A photosensitive layer of 20 μm in thickness was formed on the entire surface of each photoreceptor original pipe, then Kynar (lubricant) was applied to the entire surface of the photosensitive layer at the initial stage, and image forming experiments were successively carried out. The results are shown in Table 1 below. That is,

TABLE 1

| | Surface roughness Rz | | | | | |
|---|---|---|---|---|---|---|
| | 0.5 μm | 0.9 μm | 1.2 μm | 1.7 μm | 2.5 μm | 4.2 μm |
| Occurrences of curling | X | X | X | ○ | ○ | ○ |
| Image quality | ○ | ○ | ○ | X | X | X |
| Scattering of Toner | ○ | ○ | ○ | ○ | ○ | X |

Explaining the symbols described corresponding to the respective surface roughnesses Rz in Table 1 above, with respect to the occurrences of curling, "X" represents an occurrence of curling, and "○" represents a non-occurrence of curling; with respect to the image quality, "○" represents there was no problem, and "X" represents that a surface potential on the photoreceptor became non-uniform according to the concavities and convexities of a photoreceptor original pipe, thus generating an irregular density in an intermediate tone (half tone) image; and with respect to the scattering of toner, "○" represents that there was no toner scattered; and "X" represents that a toner of small particle sizes passed through the cleaning blade to be scattered into the apparatus.

In view of the results of Table 1, the surface roughness Rz of each photoreceptor original pipe was set to 1.2 μm or less (may be flat) in the image area as shown in FIG. 4, whereas the surface roughness Rz of each photoreceptor original pipe was set to 1.7 μm–2.5 μm outside the image area, and further experiments were conducted with each photoreceptor original pipe thus processed being built into the image forming apparatus. As a result, images of good quality were suitably formed without an occurrence of curling. In addition, in consideration of processing errors which might be caused upon processing the photoreceptor original pipes, etc., with respect to the photoreceptor 10, there were set a first range RG1 slightly larger than the image width Wimg and a second range RG2 lying outside the first range RG1 and slightly exceeding the cleaning blade width Wcl, as shown in FIG. 5, and then similar experiments as in FIG. 4 were carried out with similar results, i.e., formation of good images. As summarized from the results of the above experiments, if the above-mentioned special processing (for example, surface roughness Rz=1.7 μm) is performed on the photoreceptor original pipe in a range thereof which extends from a location lying outside the image width Wimg and inside the development width Wdev to the cleaning blade width Wcl or a location therebeyond, the friction in that range will be reduced, thereby making it possible to form good images without causing curling of the cleaning blade 21. Moreover, even when the above-mentioned special processing was carried out in a range extending from a location outside the development width Wdev and inside the cleaning blade width Wcl to a location outside the cleaning blade width Wcl, there was recognized a good effect of preventing curling of the cleaning blade. If the special processing is performed from a location inside the development width Wdev, there might be some danger that defective cleaning takes place in the portions which were subjected to the special processing, but there will be obtained a great effect on the prevention of curling of the cleaning blade. On the other hand, if the special processing is performed in a range lying outside the development width Wdev and extending from the location of the cleaning blade width Wcl to a location outside the cleaning blade width Wcl, there will be no fear of defective cleaning but with a somewhat reduced effect on the blade's curling. Any of the above cases may be selected as required of the apparatus.

Embodiment 2

Figure 6:
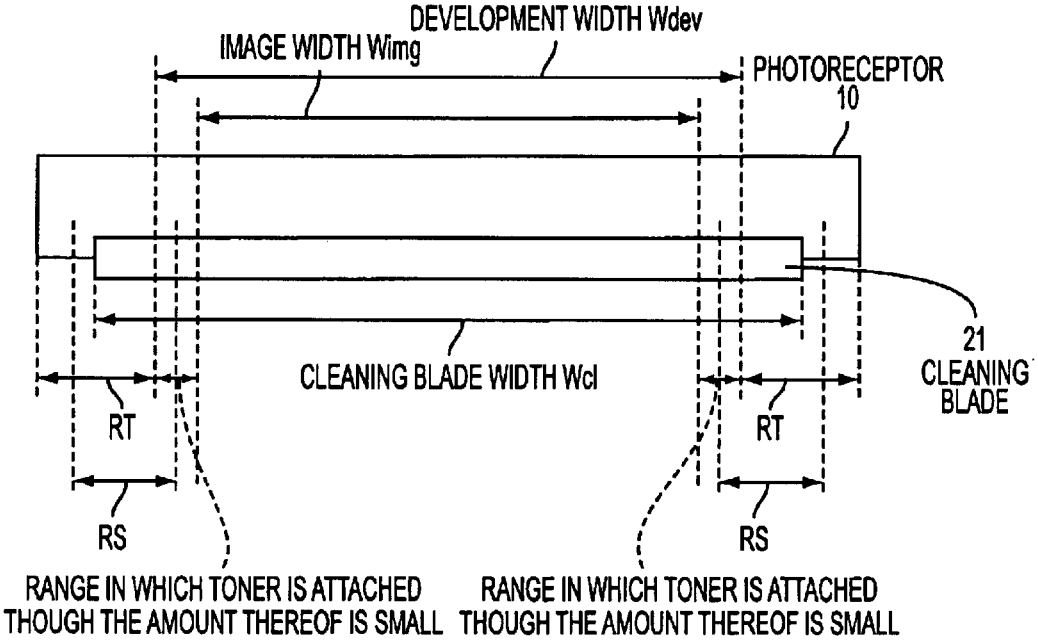
FIG. 6 is a view explaining image forming apparatuses according to a second embodiment and a third embodiment of the present invention.

Now, a second embodiment of the present invention will be described while referring to FIG. 6. In the second embodiment, no special processing is carried out on the surface of the photoreceptor original pipe, but a lubricant, which is adherable for a long term, was applied to each photoreceptor original pipe in a range RS lying outside the image width Wimg and extending from a location inside the development width Wdev to the cleaning blade width Wcl or a location therebeyond, as shown in FIG. 6. As a result, images with good quality were suitably formed without curling of the cleaning blade. As such a lubricant, there was employed a one that was formed of a fluorocarbon resin powder (a powder under the trade name of "Reflon LA" manufactured by Daikin Industries Ltd.) melted in a flon type solvent (a solvent under the trade name of "Daiflon S3" manufactured by Daikin Industries Ltd.) used in the invention disclosed in Japanese Patent Application Laid-Open No. Hei 3-197952, this lubricant being applied and adhered to each photoreceptor original pipe. Here, note that when the lubricant was applied to the entire surface of the photoreceptor including the image area of the image width Wimg, spots, which are image defects) appeared on the images thus formed, from which it was found that it is good or effective to perform application of this lubricant in a region outside the image width Wimg. In this embodiment, too, when the lubricant was applied to the photoreceptor in a region lying outside the development width Wdev and extending from a location inside the cleaning blade width Wcl to a location outside the cleaning blade width Wcl, a good effect of preventing curling of the cleaning blade was recognized, as in the first embodiment.

Embodiment 3

Next, a third embodiment of the present invention will be described. In the third embodiment, for the photoreceptor original pipe, there was selected a one whose coefficient of friction is smaller than that of a photosensitive layer formed on the photoreceptor original pipe. (For instance, a pipe made of an electroconductive polyacetal or polycarbonate may be coated with an electroconductive fluorocarbon resin.) A range in which the photosensitive layer is formed was defined by the development width Wdev, so that no photosensitive layer was formed in a range RT outside the development width Wdev (see FIG. 6). Alternatively, the photoreceptor original pipe may be processed in such a manner that a photosensitive layer is formed on the entire surface of the photoreceptor original pipe, after which the portions of the photosensitive layer lying outside the development width Wdev is removed. In this embodiment, too, images of good quality were formed without causing curling of the cleaning blade. Further, in addition to the above processing, even when the photoreceptor original pipe was subjected to the special processing according to the first embodiment, or when the lubricant was applied to the photoreceptor original pipe according to the second embodiment, good results could be obtained.

Embodiment 4

Figure 7:
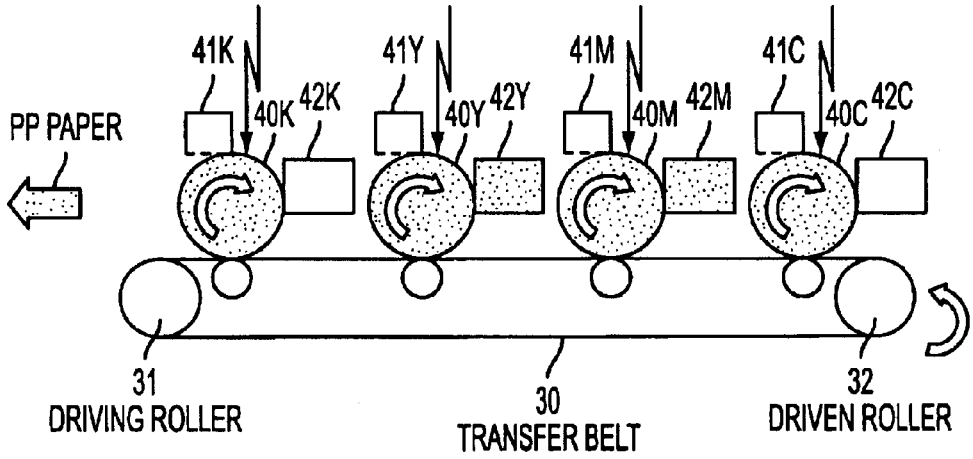
FIG. 7 is a view explaining an image forming apparatus according to a fourth embodiment of the present invention, in which the image forming apparatus using a transfer belt is illustrated.
Figure 8:
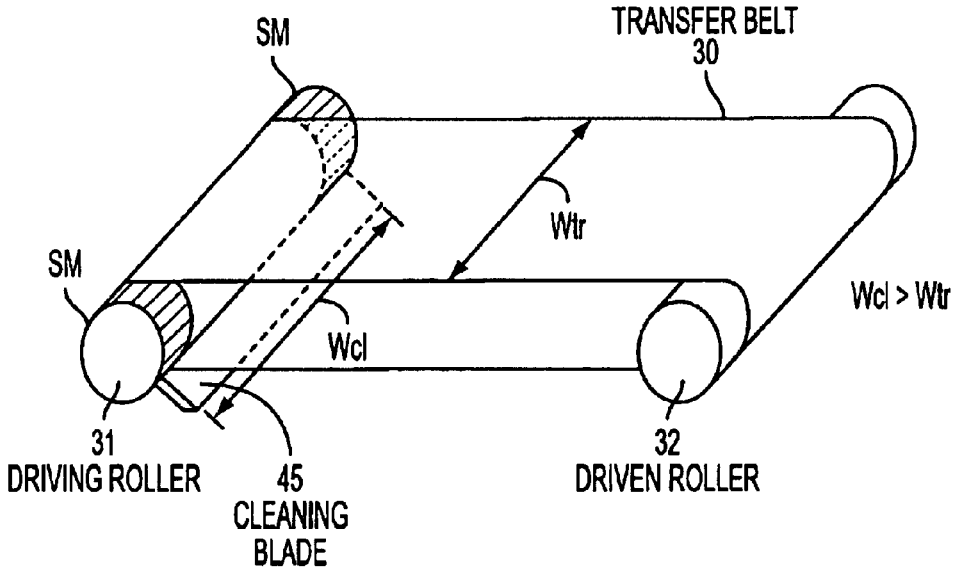
FIG. 8 is a view explaining the relation between a transfer belt and a cleaning blade shown in FIG. 7.

A fourth embodiment of the present invention will be described while referring to FIG. 7 and FIG. 8. FIG. 7 is a view explaining an image forming apparatus using a transfer belt, and FIG. 8 is a view explaining the relation between the transfer belt in FIG. 7 and a cleaning blade. Although in the embodiments shown in FIG. 1 through FIG. 6, the object to be cleaned by the cleaning blade is the photoreceptor of the cylinder drum type, this embodiment illustrates that the present invention can be applied to a transfer belt (transfer material conveying device). In the image forming apparatus shown in FIG. 7 and FIG. 8, a transfer belt 30 having a thickness of 100 $\mu$m is formed of a resin material such as polyimide, polycarbonate or the like, or of a rubber material such as CR, urethane or the like. The transfer belt 30 is arranged under an appropriate tension between a driving roller 31 and a driven roller 32, both of which act as image carrying member tensioning shafts, so that the transfer belt 30 is driven to move by means of the driving roller 31.

The formation of images on a sheet of paper PP in this image forming apparatus is performed by photoreceptors 40C, 40M, 40Y and 40K, chargers 41C, 41M, 41Y and 41K, developing devices 42C, 42M, 42Y and 42K, etc., for carrying out four-color printing. A cleaning blade 45 is arranged under the driving roller 31, as shown in FIG. 8. (But it may be arranged at the driven roller 32 side.) The width Wcl of the cleaning blade 45 is set to be greater than the width Wtr of the transfer belt 30, that is, Wcl>Wtr. In this case, the driving roller 31 should have an appropriate frictional force so as to prevent slipping against the transfer belt 30, as will be clear from the intended operation of the driving roller. When the cleaning blade 45 is pressed against the driving roller 31 at locations outside the width Wtr of the transfer belt, it is liable to be curled up or turned over due to the frictional force of the driving roller 31.

In order to prevent the occurrence of such curling, end portions SM of the driving roller 31 were subjected to the technique employed in the first embodiment or in the second embodiment, in a range lying outside the transfer belt width Wtr and extending as far as the cleaning blade width Wcl or to a location therebeyond, whereby the friction of the end portions SM could be reduced. As a result, the cleaning blade 45 was prevented from being curled up or turned over. Of course, in addition to this, the friction reducing processing according to the first embodiment or the second embodiment was performed on the portions of the transfer belt lying outside the image forming area (latent image forming area). On the other hand, if the width Wcl of the cleaning blade 45 is narrower than the width Wtr of the transfer belt 30, that is, Wcl≦Wtr, unlike the example shown in FIG. 7 and FIG. 8, those portions of the transfer belt, with which the opposite end portions of the cleaning blade 45 are in abutment, may be subjected to the processing carried out in the first embodiment or the second embodiment, thereby reducing the friction at the opposite ends of the cleaning blade 45.

Embodiment 5

Figure 9:
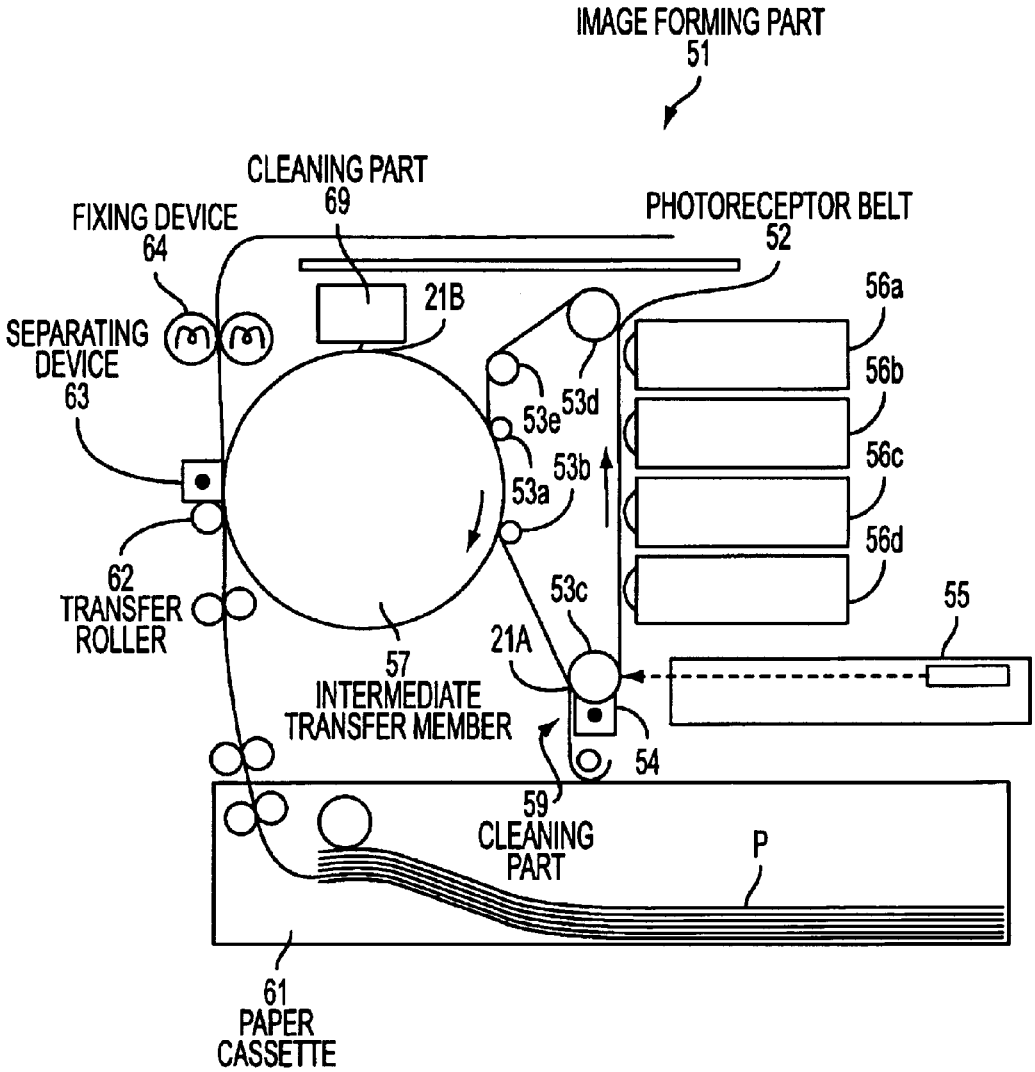
FIG. 9 is a cross sectional view explaining an image forming apparatus according to a fifth embodiment of the present invention.
Figure 10:
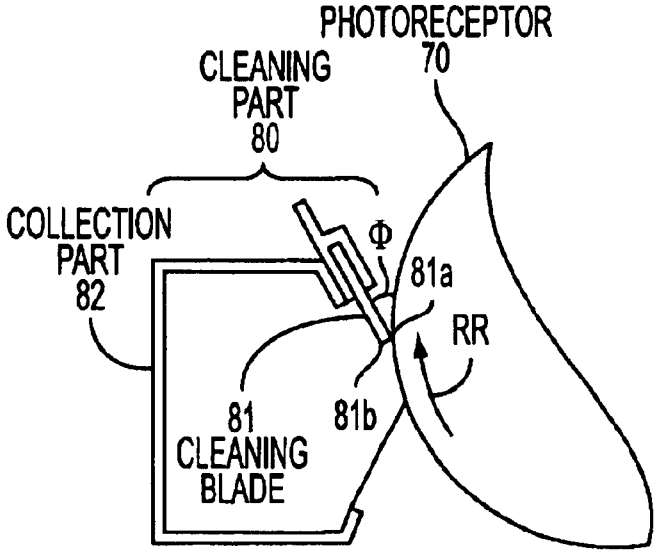
FIG. 10 PRIOR ART
FIG. 10 is a cross sectional view illustrating a known image forming apparatus.
Figure 11:
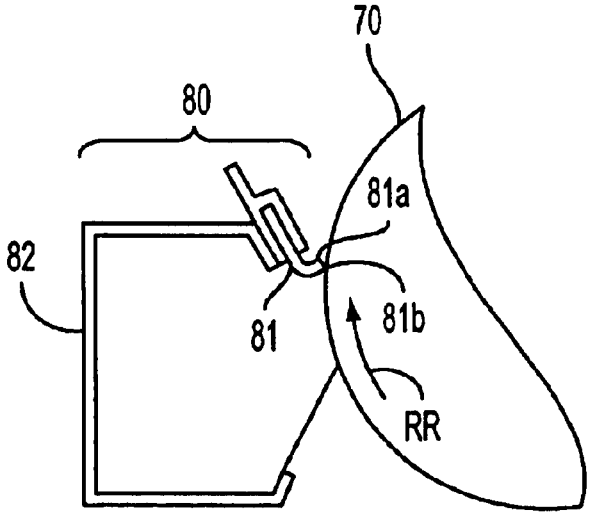
FIG. 11 PRIOR ART
FIG. 11 is a view explaining a situation in which there takes place curling of a cleaning blade in the image forming apparatus of FIG. 10.

A fifth embodiment of the present invention will be described while referring to FIG. 9. FIG. 9 is a view explaining an image forming apparatus in which the present invention is applied to an intermediate transfer member. This image forming apparatus is provided with an image forming part 51 for forming an image on a photoreceptor belt 52. The photoreceptor belt 52 is arranged under tension among a plurality of rollers 53*a*–53*e*, so that it is driven to move in a direction of an arrow. A charging device 54, an exposure device 55, developing devices 56C, 56M, 56Y and 56K, all of which together constitute a latent image forming device, are arranged along the photoreceptor belt. An intermediate transfer member 57, which constitutes an intermediate transfer device for temporarily carrying a toner image formed on the photoreceptor belt 52, is arranged at a side of the photoreceptor belt 52. A plurality of sheets of printing paper P are stored in a paper cassette 61, and a sheet of paper P is transported by various rollers to pass through between the intermediate transfer member 57 and a transfer roller 62 constituting a transfer device and between the intermediate transfer member 57 and a separating device 63. During the passage of the paper, a toner image formed on the intermediate transfer member 57 is transferred to the paper sheet P. Thereafter, the paper sheet P passes through a fixing device 64 whereby the toner image is fixed to the paper sheet P. The toner remaining on the photoreceptor belt 52 and the intermediate transfer member 57 without being effectively used to form the image can be scraped off by cleaning blades 21A, 21B of cleaning parts 59, 69, respectively. In this case, the fourth embodiment shown in FIG. 7 and FIG. 8 may be applied to the photoreceptor belt 52 and the cleaning part 59, and the first through third embodiments shown in FIG. 1 through FIG. 6 may be applied to the intermediate transfer member 57 and the cleaning part 69.

As an image forming apparatus of the present invention is constructed as described above, it is possible to realize an image forming apparatus which is capable of preventing a problem peculiar to a cleaning blade that the cleaning blade would be curled up or turned over as the operating time of the image forming apparatus elapses, or due to the shape of an image forming pattern.

While the invention has been described in terms of preferred embodiments, those skilled in the art will recognize that the invention can be practiced with modifications within the spirit and scope of the appended claims.

What is claimed is:

1. An image forming apparatus comprising:

an image carrying member having a photosensitive layer and a photosensitive layer carrying member carrying said photosensitive layer;

a latent image forming device for forming a latent image in a latent image forming area on said image carrying member in accordance with image information;

a developing device for forming a toner image on said latent image in a developing area;

a transfer device for transferring said toner image to a transfer material; and cleaning device for removing a residual toner attached to said image carrying member by means of a blade-shaped abutment member, wherein a surface roughness of said photosensitive layer carrying member is greater outside said latent image forming area on said image carrying member and outside said developing area than in said latent image forming area.

2. The image forming apparatus according to claim 1, wherein concavities and convexities are provided on said photosensitive layer carrying member in a direction parallel to a direction in which said image carrying member rotates.

3. The image forming apparatus according to claim 2, wherein a surface roughness Rz outside said latent image forming area is 1.7–4.0 $\mu$m.

4. The image forming apparatus according to claim 1, wherein said image carrying member is cylindrical.

5. The image forming apparatus according to claim 1, wherein said image carrying member is of a belt-shaped configuration.

6. An image forming apparatus comprising:

an image carrying member having a photosensitive layer and a photosensitive layer carrying member carrying said photosensitive layer;

a latent image forming device for forming a latent image in a latent image forming area on said image carrying member in accordance with image information;

a developing device for forming a toner image on said latent image in a developing area;

a transfer device for transferring said toner image to a transfer material; and a cleaning device for removing a residual toner attached to said image carrying member by means of a blade-shaped abutment member;

wherein a lubricant having a friction against said abutment member smaller than that of said photosensitive layer is applied to said photosensitive layer carrying member outside said latent image forming area on said image carrying member and outside said developing area for forming said toner image.

7. An image forming apparatus comprising:

an image carrying member having a photosensitive layer and a photosensitive layer carrying member carrying said photosensitive layer;

a latent image forming device for forming a latent image in a latent image forming area on said image carrying member in accordance with image information;

a developing device for forming a toner image on said latent image in a developing area;

a transfer device for transferring said toner image to a transfer material; and a cleaning device for removing a residual toner attached to said image carrying member by means of a blade-shaped abutment member;

wherein outside said latent image forming area on said image carrying member and outside said developing area, said photosensitive layer is removed from said photosensitive layer carrying member, and a friction against said abutment member is smaller in said photosensitive layer carrying member than in said photosensitive layer.

8. The image forming apparatus according to claim 7, wherein a surface of said photosensitive layer carrying member is formed of an electroconductive fluorocarbon resin.

9. An image forming apparatus comprising:

an image carrying member having a photosensitive layer and a photosensitive layer carrying member carrying said photosensitive layer;

a latent image forming device for forming a latent image in a latent image forming area on said image carrying member in accordance with image information;

a developing device for forming a toner image on said latent image in a developing area;

an intermediate transfer device for transferring said toner image so as to temporarily carry it thereon;

a transfer device for transferring said toner image on said intermediate transfer device to a transfer material; and an intermediate transfer cleaning device for removing a residual toner attached to said intermediate transfer device by means of a blade-shaped intermediate transfer abutment member, wherein a friction against said intermediate transfer abutment member is smaller in portions of said intermediate transfer device outside said latent image forming area and outside the developing area than in a portion of said intermediate transfer device in said latent image forming area.

10. The image forming apparatus according to claim 9, wherein the lubricant is applied to portions of said intermediate transfer device outside said latent image forming area and outside the developing area for forming the toner image.

11. An image forming apparatus comprising:

an image carrying member having a photosensitive layer and a belt-shaped photosensitive layer carrying member carrying said photosensitive layer;

a plurality of image carrying member tensioning shafts among which said image carrying member is arranged under tension;

a latent image forming device for forming a latent image on said image carrying member in accordance with image information;

a developing device for forming a toner image on said latent image;

a transfer device for transferring said toner image to a transfer material; and a cleaning device for removing a residual toner attached to said image carrying member by means of a blade-shaped abutment member, wherein said abutment member is greater in width than said image carrying member, and is arranged in a position to clamp said image carrying member together with one of said image carrying member tensioning shafts; and a friction against said abutment member is smaller at least in a portion of said image carrying member tensioning shaft with which said abutment member is in direct contact than in said image carrying member.

12. The image forming apparatus according to claim 11, wherein a lubricant is applied to at least the portion of said image carrying member tensioning shaft with which said abutment member is in direct contact.

13. An image forming apparatus comprising:

an image carrying member having a photosensitive layer and a photosensitive layer carrying member carrying said photosensitive layer;

a latent image forming device for forming a latent image on said image carrying member in accordance with image information;

a developing device for forming a toner image on said latent image;

a transfer device for transferring said toner image to a transfer material;

a transfer material conveying device for conveying said transfer material to said transfer device while carrying said transfer material thereon;

a plurality of transfer material conveying tensioning shafts among which said transfer material conveying device is arranged under tension; and a transfer material conveying cleaning device for removing a residual toner attached to said transfer material conveying device by means of a blade-shaped transfer material conveying abutment member, wherein said transfer material conveying abutment member is larger in width than said transfer material conveying device, and arranged in a position to clamp said image carrying g member together with one of said transfer material conveying tensioning shafts; and a friction against said transfer material conveying abutment member is smaller at least in a portion of said transfer material conveying tensioning shaft with which said transfer material conveying abutment member is in direct contact than in said transfer material conveying device.

14. The image forming apparatus according to claim 13, wherein a lubricant is applied to at least the portion of said transfer material conveying tensioning shaft with which said transfer material conveying abutment member is in direct contact.

* * * * *